United States Patent [19]

Rule

[11] 4,272,850

[45] Jun. 16, 1981

[54] BODY PROTECTIVE PADS

[75] Inventor: Robert J. Rule, Manhasset, N.Y.

[73] Assignee: W. H. Brine Company, Milford, Mass.

[21] Appl. No.: 42,582

[22] Filed: May 25, 1979

[51] Int. Cl.[3] ..... A41D 13/06

[52] U.S. Cl. ..... 2/24

[58] Field of Search ..... 2/24, 16, 20, 22

[56] References Cited

U.S. PATENT DOCUMENTS

| | | | |
|---|---|---|---|
| 61,841 | 2/1867 | Lewis | 2/16 X |
| 942,751 | 12/1909 | Robbins | 2/24 |
| 1,158,208 | 10/1915 | Hart | 2/22 |
| 3,772,704 | 11/1973 | Carbonneau | 2/22 |
| 3,882,548 | 5/1975 | Shinagawa et al. | 2/16 X |

FOREIGN PATENT DOCUMENTS

| | | | |
|---|---|---|---|
| 37579 | 8/1956 | Fed. Rep. of Germany | 2/24 |

*Primary Examiner*—H. Hampton Hunter

*Attorney, Agent, or Firm*—Wolf, Greenfield & Sacks

[57] ABSTRACT

A protective pad for use in cushioning the body has a resilient organic foam polymeric material with body cushioning properties. The pad has an undersurface facing the body and a scored top surface forming an increased flexibility in the pad to better enable it to conform to the joint or other body area which it is protecting. This increased flexibility and body conforming property is obtained without substantial loss of body cushioning and protective properties.

6 Claims, 7 Drawing Figures

BODY PROTECTIVE PADS

BACKGROUND OF THE INVENTION

Body protective pads are used in various industrial and athletic activities by humans. Most often pads which protect body joints such as the elbow and knee are most difficult to properly form with the required degree of protective and cushioning properties as well as the necessary degree of conformity to the body and flexibility in use to allow unhampered use of the joint by the individual.

A variety of protective pads have been used in the past. In nearly all such pads, a pad or cushioning material of some sort is enclosed by a wrapper which holds the pad to the body. Various premolded configurations have been suggested for use. Organic polymeric foam materials are often used because of their good cushioning and protective properties. However, such organic polymeric foam materials when used often are particularly sensitive to difficulties in conformability and moldability to the body and do decrease flexibility of the athlete's joint.

SUMMARY OF THE INVENTION

It is an important object of this invention to provide a protective pad for use in protecting and cushioning the body which pad is comfortable to wear, formable to the body and yet allows great flexibility to an individual user.

It is another object of this invention to provide a pad in accordance with the preceding object which pad is particularly suitable for use in elbow and knee joint guards and allows great flexibility of the joints without substantial restriction by the pad.

It is still another object of this invention to provide a pad in accordance with the preceding object which is formed of an organic polymeric foam material having an outer scored surface which increases flexibility of the pad without substantially decreasing protective and cushioning action of the pad.

According to the invention a protective pad for use in protecting and cushioning the body as at the elbow or knee joint, has a resilient organic polymeric foam material which has body cushioning and mechanically protective properties. The pad has an undersurface designed to face a body area to be protected and an opposed top outer surface. A series of score lines extend from the top surface toward the under-surface to increase the ability of the pad to flex while maintaining body cushioning properties of the pad. Preferably the pads are formed with a slight curvature to engage a joint of the body and protect it. They may be covered with conventional elasticized materials to hold the pad in position on the joint.

In the preferred embodiments, the score lines extend from about 25 to 75% of the thickness of the pad and enable the pad upper surface to open to a slight degree when flexed so as to provide the required increased flexibility without enabling objects to pass into the spread apart portions of the pad which might adversely affect the cushioning and protective properties of the pad.

It is a feature of this invention that pads can be made for use in protecting various parts of the body using substantially conventional padding materials and without complicated formulation changes or manufacturing difficulties. When the score lines are straight lines such as square or diamond shape patterns being formed by parallel cuts, they can be made on flat sheets of the material during manufacturing procedures that allow high production rates.

BRIEF DESCRIPTION OF THE DRAWINGS

The above and other features, objects and advantages of the present invention will be better understood from a reading of the following specification in conjunction with the attached drawings in which.

DESCRIPTION OF PREFERRED EMBODIMENTS

Figure 1:
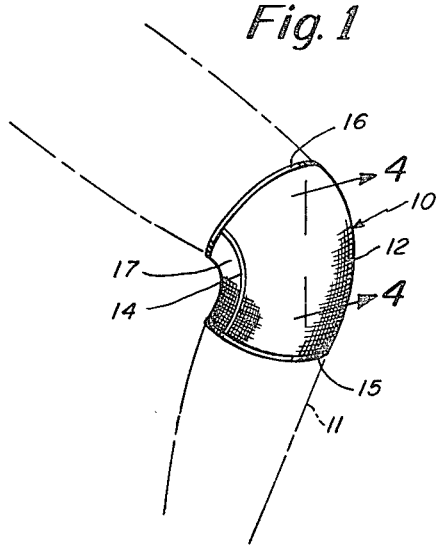
FIG. 1 is a front perspective view of a knee guard on a knee embodying a protective pad of the preferred embodiment of this invention.
Figure 7:
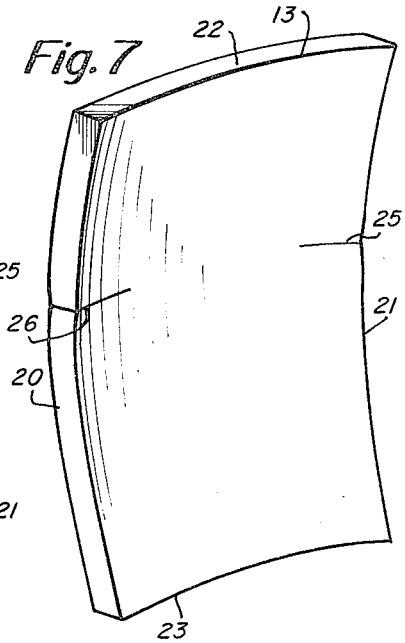
FIG. 7 is a perspective view thereof showing the shaped pad prior to enclosure in the elasticized knee guard.

With reference now to the drawings and more particularly FIGS. 1 and 7, a knee guard 10 is illustrated covering a knee 11 of an individual. The knee guard 10 has a conventional outer elasticized cloth wrapping 12 which may be of any conventional elastic material having sewn within a pocket in it a protective pad 13 of this invention. The pad 13 is enclosed within an overlayer 20 of the elasticized material sewn along parallel side seams 14 and end seams 15 and 16 to an encircling collar piece 17 of the knee guard. The invention lies in the pad 13 with the means for securing it to the joint being of any conventional nature.

The protective and cushioning pad 13 is formed of a resilient organic polymeric foam material as known in the art for cushioning elbows, knees and other body parts. Closed cell materials are preferred but open cell foams can be used. Such polymeric foams include natural and synethetic rubber foams as well as rubber blends, polypropylene foams, vinyl foams, urethanes and the like. The term "foam" is meant to denote some gas cells or passageways in the material which could be microporous. In some cases, solid, natural and synthetic rubber can be used. In the preferred embodiment, Rubatex, a trademarked product of Rubatex Corporation of Bedford, Virginia, is used. Rubatex R-310-V and R-326V closed cell vinyl-nitrile rubbery polymers are preferred and have the following properties:

| Property | Value |
|---|---|
| ASTM D-1056-67 | SBE-41-42 |
| ASTM D-1056-68 | SBE-41-42 |
| ASTM D-1056-73 | RE-41-42-E2 |
| ASTM D-1667-64 | VE-41-42 |
| Compression Deflection (p.s.i.) | 4-8 |
| Shore 00 Durometer (Approx. Average) | 40-60 |
| Density (p.c.f.) Average | 5-10 |
| Water Absorption By Weight | 10% |

-continued

| Property | Value |
|---|---|
| (Max.) | |
| Temperature Range (°F.) | |
| Low (Flex without cracking) | +20° |
| High Continuous | 130° |
| High Intermittent | 200° |
| Compression Set (Average) | |
| ASTM-D-1056 ½" | |
| compressed 50% | |
| 22 hrs. @ 70° F. - 24 hrs. | |
| recovery | 15%-35% |
| ASTM D-1667 ½" | |
| compressed 25% | |
| 22 hrs. @ 70° F. - 24 hrs. | |
| recovery | 10%-20% |
| Heat Aging | |
| (7 days @ 158° F.) | |
| Lineal Shrinkage (Max.) | 5% |
| Tensile Strength | |
| (p.s.i. Min.) | 90 |
| Elongation (% Min.) | 175 |
| K Factor | |
| (@ 75° F.) | |
| Btu. · in./hr. · sq.ft. · °F. | 0.30 |
| Resilience | |
| Bayshore (% Rebound Average) | |
| (½" thickness @ 72° F.) | 12-18 |

The cushioning pad as conventional in knee joints is of generally rectangular form having long side edges 20 and 21 and opposed shorter side edges 22 and 23. The rectangle may for example be 5½ inches ×8½ inches with a thickness of ½ inch in the preferred embodiment. These dimensions can vary greatly depending upon the area to be covered, the amount of flexing and the degree of cushioning desired. Preferably the foams having densities of from 5 to 10 pounds/cu/ft. and compression deflections of from 4 to 8 p.s.i. with Shore 00 Durometers of from average approximates of from 40 to 60, are preferred for use.

Figure 6:
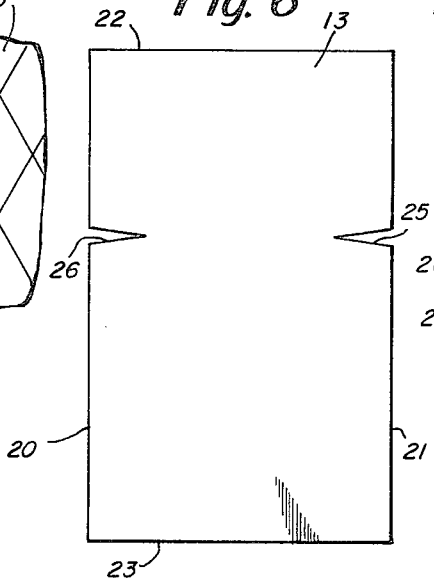
FIG. 6 is a top plan view of a pad of this invention showing a manufacturing step.

The foam pad 13 of the preferred embodiment as best shown in FIG. 6 is preferably cut at 25 and 26 with the cutout triangular portions, which may for example have a short triangular base of ¼ inch and a depth from the side line of one inch, then being glued together to form the shape shown in FIG. 7. Alternately that shape can be pre-molded into the protective pad. The slight bend created helps to position the knee guard in use when the joint is flexed to a bent position or remains in its straight position. The molding or shaping need not be present in all forms of the invention.

Figure 2:
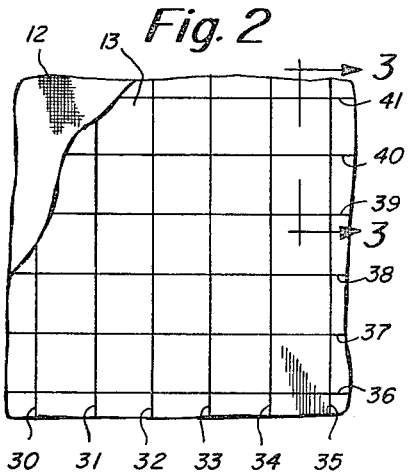
FIG. 2 is a fragmentary view thereof with the elastic covering broken away.
Figure 3:
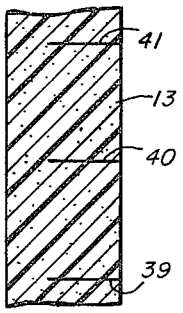
FIG. 3 is a cross sectional view through line 3—3 of FIG. 2.
Figure 4:
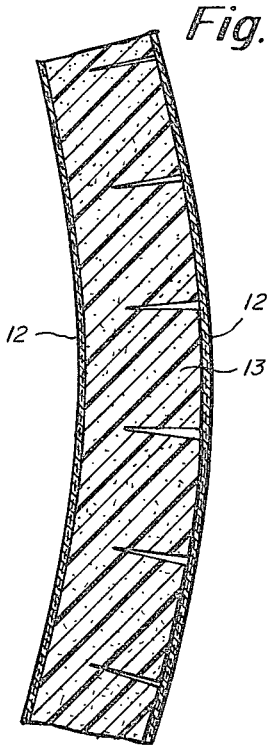
FIG. 4 is a cross sectional view through line 4—4 of FIG. 1.

The pad as described above is substantially conventional. The invention lies in the scoring of the pad as best shown in FIGS. 2-4. Cushioning pad 13 of the preferred embodiment has a series of parallel score lines 30, 31, 32, 33, 34, 35 perpendicular to score lines 36, 37, 38, 39, 40 and 41 to form small one centimeter squares on the outer surface of the pad. The inner surface of the pad as best shown in FIG. 4 is unscored and smooth in the preferred embodiment. It underlies the pad and is positioned to face the body of the user while the outer surface which is scored, faces away from the body and is designed to permit ease of flexing. The score lines preferably extend substantially into the pad as best shown in FIG. 3 and can be more than halfway through the pad. The greater the depth of the score lines, the greater the flexibility of the material.

Surprisingly even though the pad is scored, when it is flexed as shown in FIG. 4, the score lines open only slightly which prevent foreign objects from entering into the slight opening in the pad providing substantially complete resiliency and cushioning to prevent mechanical damage to the underlying body. Partially because the score lines are in more than one angular direction to each other, movement of the foot in various planes can be accommodated with the cushioning and protective pad tending to mold or conform to the body allowing great flexibility to the athlete or user and avoid inhibiting flexing of the body joint. Comfort to the user is considerable as compared to previously used unscored cushioning pads.

The score lines permit spreading of the top surface of the pad when the pad is flexed so that normally facing walls of the indentations formed by the score lines move apart to define a flexed opening therebetween without said opening exceeding a distance that is greater than the distance of objects likely to engage and strike the pad.

The score lines of the preferred embodiment preferably have a depth of slightly more than one-quarter of an inch and are formed by cutting saws having a thickness of from about ½ to about 50 millimeters. Thus slight bends as in FIG. 4 cause only millimeter size openings as for example 6 to 8 millimeter openings between various portions formed in the pad. It is preferred that the score lines not allow large openings to avoid foreign objects entering into the pad and thus destroying some of the cushioning value of the pad beyond that which would be safe.

Figure 5:
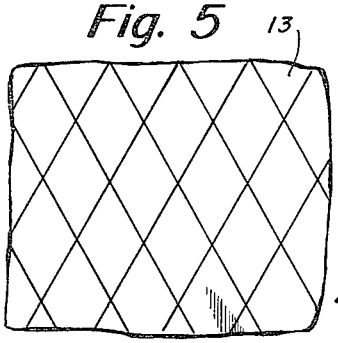
FIG. 5 is a front view of an alternate score line pattern.

While generally perpendicular score lines are preferred for use, the score lines can be in various patterns. For example, in FIG. 5, a diamond-shaped pattern is used. Most preferably the lines of scoring or cutting are parallel to each other which makes manufacture easier than if irregular shapes were used. Pads cut in that manner then flex along the body's own lines of stress-longitudinally and latitudinally.

The score lines result in a drammatic drop in the amount of pressure required to bend the cushioning pad. Pressure is an indication of comfort in use. In conventional arm and knee pads there is often discomfort to the fatigue of a wearer caused by the fact that pads of adequate protection cause binding problems. Binding is the refusal of the pad to bend at the proper time and in the proper areas. This binding force is caused by a single piece solid pad's inability to adjust to a limb's rapid changes in movement and can add to fatigue and discomfort to a wearer. The scoring lines of the present invention overcome that problem without increasing flexibility of the material used which by itself might cause a loss in protective qualities. Thus a softer or more flexible foam which might add to comfort, would not have the mechanical shock dampening value of a harder foam. In the present case since score lines are used, the conventional most desirable protective pads can be used and the advantages of flexibility also obtained.

In a test of flexbility of a preferred pad 13 of this invention, a conventional pad unscored is compared with a scored pad with the score lines made to various depths from the top surface and various distances apart of the score lines. An electronic digital readout scale accurate to 0.01 pounds is used and five identical pads of the same material, size, thickness, weight and shape are used. Each pad was scored to the correct depth and surface area as indicated in columns 1 and 2 of the following chart except for the control pad which was not scored.

Starting with the control pad, each pad was placed horizontally on a scale pan with its concave side as shown in FIG. 7 down. Along the left longitudinal (long side) edge the pad was bent until one longitudinal edge touched the other edge. The pressure required to do this in terms of pounds was read off of the scale to the 0.01 of a pound. The sequence was then repeated for the lateral (short side) edge. This process was repeated for all pads and the data taken is recorded in columns 3 and 4 of the following chart.

Using the following formula which allows the control pad to be the constant, the comparison of flexibility was determined for each pad as related to the control and then converted to a percentage figure for ease of comparison. The complete test results are shown in columns 3, 4 and 5. The formula used was as follows:

The formula: $\frac{\text{difference from control pad}}{\text{test results of specific pad}} = \frac{X}{100}\ \%$ example: using pad $E$ test results Longitudinal pressure:

$$\frac{4.00\text{ lbs} - 1.00\text{ lbs}}{1.00\text{ lbs}} = \frac{X}{100} \quad (1)$$

$$\frac{3.00}{1.00} = \frac{X}{100} \quad (2)$$

$$X = 300\% \quad (3)$$

Latitudinal pressure:

$$\frac{1.38\text{ lbs} - .30\text{ lbs}}{.30\text{ lbs}} = \frac{X}{100}\ \% \quad (1)$$

$$\frac{1.08}{.30} = \frac{X}{100}\ \% \quad (2)$$

$$.30X = 108 \quad (3)$$

$$X = 360\% \quad (4)$$

The test results were recorded in column 5 of the following chart in increasing flexibility from row A to row E of the pads of this invention. A plurality of pads were each bent so that each edge longitudinally and laterally touched. This was done 3000 times in each direction for each of five pads. The bending was carried out by hand. The control pad without score lines showed slight stress cracks at the point of bending both longitudinally and laterally while the scored pads showed no visible signs of stress cracks because of their ability to bend using less pressure along established stress lines caused by the score lines.

When pads formed as shown in B, C, D and E of the below test results chart were used by high school wrestlers in their normal routine, the pads held up well and showed no excessive wear as compared to control pads having no scored lines.

TEST RESULTS

| | 1 Shape of surface cut | 2 Depth of cut | 3 Lbs. Pressure Longitude | 4 Lbs. Pressure Latitude | 5 % difference Flexibility | 6 Increasing Flexibility |
|---|---|---|---|---|---|---|
| A | control pad | | 4.00 | 1.38 | | |
| B | 1 cm² scored | 25% | 2.00 | 1.00 | Longitude: 100% Latitude: 38% | |
| C | 2 cm² scored | 50% | 1.60 | .60 | Longitude: 150% Latitude: 130% | |
| D | Diamond shape | 50% | 1.30 | | .60 Longitude: 270% Latitude: 130% | |

-continued

TEST RESULTS

| | 1 Shape of surface cut | 2 Depth of cut | 3 Lbs. Pressure Longitude | 4 Lbs. Pressure Latitude | 5 % difference Flexibility | 6 Increasing Flexibility |
|---|---|---|---|---|---|---|
| E | 1 cm² scored | 50% | 1.00 | | .30 Longitude: 300% Latitude: 360% | |

While particular embodiments of the invention have been shown and described, many variations are possible. For example, the dimensions of the pad may run from widths of from 1 to 20 inches and lengths of from 1 to 25 inches depending upon the areas of the body to be protected. The pads need not be rectangular but can be round, square or of irregular shape. The score lines may run from parallel distances apart of from half a centimeter and sometimes less to as much as 5 centimeters. The depth of scoring will depend in part on the depth or thickness of the pad and can run from at least 1 millimeter to 3 centimeters along with pad thicknesses of from ¼ centimeter to 3 centimeters. The densities of the pads used may vary from standard low to high density just as the materials can vary greatly. While the pads are preferably enclosed in elasticized wrappings, they can be attached to or positioned against the body in other ways. For example, straps can be used to strap on the pads or the pads can be attached to garments positioned over the joint or even merely placed next to the knee and held in place by a high sock. The pads can be used as chest protectors, glove padding, knee and elbow pads and the like.

What is claimed is:

1. A protective pad for use in cushioning and protecting the body, said pad comprising a resilient organic polymeric foam material having body cushioning properties and a predetermined thickness, said pad having an undersurface designed to face a body area to be protected and an opposing top outer surface, and a series of thin score lines extending from said top surface toward said undersurface to increase the ability of said pad to flex while maintaining body cushioning properties of said pad, said score lines comprising a first and second series of lines with the first and second series of lines being angularly arranged with respect to each other to aid in accommodating movement of an underlying body portion in various planes, said score lines having a depth of at least about 25% of the thickness of said pad, said score lines permitting spreading of the top surface of said pad when said pad is flexed so that normally facing walls of the indentations formed by the score lines move apart to define a flexed opening therebetween without said opening exceeding a distance that is greater than the distance of objects likely to engage and strike the pad.

2. A protective pad as claimed in claim 1 and further comprising an elastic fabric mounting said pad in a body mounting position.

3. A protective pad as claimed in claim 1 and further comprising said pad being preformed to define a slight depression to engage a joint of a body length.

4. A protective pad in accordance with claim 2 wherein said resilient organic material is closed cellular vinyl-nitrile polymer and said pad has a thickness of ½ inch with a generally rectangular outer configuration.

5. A protective pad as claimed in claim 2 and further comprising said pad being preformed to define a slight depression to engage a joint of a body length.

6. In a protective pad for use in protecting and cushioning the body, said protective pad being formed of an organic polymeric elastomeric foam material having a defined flexibility and shock resisting property, the improvement comprising, a series of thin score lines in a top surface of said pad with an opposed bottom surface designed and dimensioned to lie against the body, said thin score lines permitting greater flexing of said pad than otherwise would be possible while allowing said pad to conform to movements of the body with minimized body efforts to obtain such movement, said score lines comprising a first series of parallel score lines and a second series of parallel score lines angularly arranged with respect to said first series, said score lines having a depth of at least about 25% of the thickness of said pad, said score lines permitting spreading of the top surface of said pad when said pad is flexed so that normally facing walls of the indentations formed by the score lines move apart to define a flexed opening therebetween without said opening exceeding a distance that is greater than the distance of objects likely to engage and strike the pad, and said foam material having a Shore 00 Durometer of an average approximate of from about 40 to about 60.

* * * * *